United States Patent [19]

Hooper

[11] 4,440,083

[45] Apr. 3, 1984

[54] DISPOSABLE INKING CARTRIDGE

[75] Inventor: Clinton E. Hooper, Brookfield, Conn.

[73] Assignee: Pitney Bowes Inc., Stamford, Conn.

[21] Appl. No.: 458,246

[22] Filed: Jan. 17, 1983

[51] Int. Cl.[3] ..... B41F 31/00

[52] U.S. Cl. ..... 101/348; 101/103; 101/295; 101/301; 101/310; 101/324; 101/335; 101/359

[58] Field of Search ..... 101/81, 82, 97, 98, 101/101, 103, 288, 293, 295, 301, 302, 303, 304, 305, 310, 318, 320, 324, 326, 335, 348, 349, 353, 359; 400/196, 196.1, 202.2, 202.3, 202.4, 208, 470, 471, 471.1; 24/230 R, 230 AK, 230 BC; 118/256, 257, 258, DIG. 15; 222/325; 401/218; 403/204

[56] References Cited

U.S. PATENT DOCUMENTS

| | | | |
|---|---|---|---|
| 3,785,288 | 1/1974 | Hunter | 101/103 |
| 4,044,677 | 8/1977 | Hamisch, Jr. | 101/103 |
| 4,051,781 | 10/1977 | Nishikawa | 101/103 |
| 4,152,984 | 5/1979 | Utzinger | 101/103 |
| 4,252,060 | 2/1981 | Strausburg | 101/295 |
| 4,273,046 | 6/1981 | Sato | 101/295 |
| 4,387,645 | 6/1983 | Holland-Letz et al. | 101/305 |

*Primary Examiner*—Edgar S. Burr

*Assistant Examiner*—David A. Wiecking

*Attorney, Agent, or Firm*—Lawrence E. Sklar; William D. Soltow, Jr.; Albert W. Scribner

[57] ABSTRACT

A disposable inking cartridge in combination with a housing for transferring ink to a secondary surface, including a housing having a pair of sidewalls, each of the sidewalls having a locating guide, wherein the locating guide includes at its trailing end a leg forming an acute or perpendicular angle therewith, an applicator roller rotatably mounted in the housing for transferring ink to a secondary surface, and a disposable inking cartridge lockingly mountable in the sidewalls of the housing. The cartridge includes a floating spindle translatable in a direction perpendicular to the locating guides in the housing sidewalls, an inking roller rotatably mounted on the spindle and engagable with the applicator roller, and a pair of sidewalls, each of the sidewalls having a locating guide, wherein the cartridge locating guide includes at its trailing end a leg forming an acute or perpendicular angle therewith, and wherein the cartridge locating guide slidingly engages the housing locating guide, whereby when the cartridge is inserted into the housing the legs of the cartridge guide pass the legs of the housing guides and are urged upward by the floating spindle into locking engagement with the housing sidewalls.

6 Claims, 7 Drawing Figures

10
12
14
16
20
24
27
28
31
32
34
35
36
37
39
84
86
88
90
91
92
94
96
98
100

10
14
18
22
26
28
29
32
33
36
84
86
88
90
91
92
94
96
98
100

32
36
37
38
39
50
52
53
54
55
56
57
58
59

DISPOSABLE INKING CARTRIDGE

BACKGROUND OF THE INVENTION

The instant invention relates to a disposable inking cartridge and more particularly to such a cartridge having a floating spindle therein.

In systems for transferring ink to a secondary surface, it is known to utilize disposable cartridges having an inking roller rotatably mounted therein which is biased against a secondary surface which transfers ink to a printing cylinder in order that the person changing the cartridge does not have to handle an inking roller. However, prior art disposable cartridges have required elaborate means for mounting in the printing apparatus.

Accordingly, the instant invention provides a disposable inking cartridge which by virtue of a floating spindle and housing design can be loaded against a secondary surface and locked into a mounting detent in the printing apparatus with one simple motion by the operator. The invention is particularly applicable to a mailing machine and postage meter.

SUMMARY OF THE INVENTION

The instant invention provides a disposable inking cartridge in combination with a housing for transferring ink to a secondary surface, and comprises a housing having a pair of sidewalls, each of the sidewalls having a locating guide, wherein the locating guide includes at its trailing end a leg forming an acute or perpendicular angle therewith, an applicator roller rotatably mounted in the housing for transferring ink to a secondary surface, and a disposable inking cartridge lockingly mountable in the sidewalls of the housing. The cartridge includes a floating spindle translatable in a direction perpendicular to the locating guides in the housing sidewalls, an inking roller rotatably mounted on the spindle and engageable with the applicator roller, and a pair of sidewalls, each of said sidewalls having a locating guide, wherein the cartridge locating guide includes at its trailing end a leg forming an acute or perpendicular angle therewith, and wherein the cartridge guide slidingly engages the housing guide, whereby when the cartridge is inserted into the housing the legs of the cartridge guides pass the legs of the housing guides and are urged upward by the floating spindle into locking engagement with the housing sidewalls.

Figure 1:
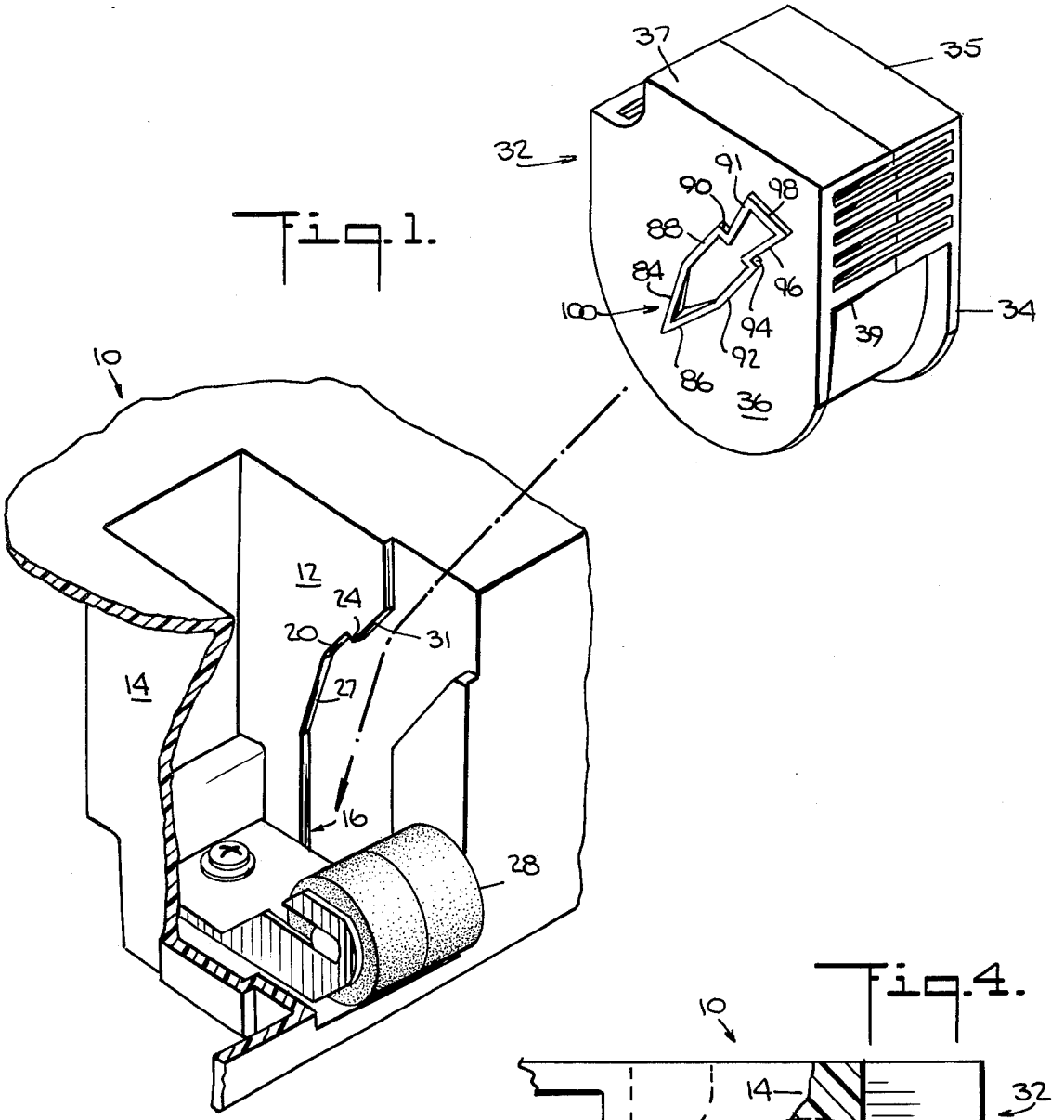
FIG. 1 is a perspective view of an inking cartridge and housing therefor prior to the cartridge being inserted into the sidewalls of the housing.

The mailing machine 10 also includes an applicator or drive roller 28 rotatably mounted therein for transferring ink to a secondary surface such as a printing drum 30 of a postage meter (not shown). Ink is supplied to the drive roller 28 by a disposable inking cartridge generally designated 32, which is lockingly mountable in the sidewalls 12 and 14 of the mailing machine 10.

The disposable inking cartridge 32 includes a pair of sidewalls 34 and 36 having peripheral walls 35 and 37 respectively which together have an aperture 39. Extending from inside the sidewall 34 is a fixed beam 38 (see FIG. 6) having a flange portion 40 extending upwardly therefrom and contiguous with and perpendicular with the inside of the sidewall 34. Parallel to the flange portion 40 and extending from both sides of the beam 38 are a first pair of guide rails 42 and 44 and a second pair of guide rails 46 and 48 parallel to the first pair of guide rails 42 and 44.

Figure 7:
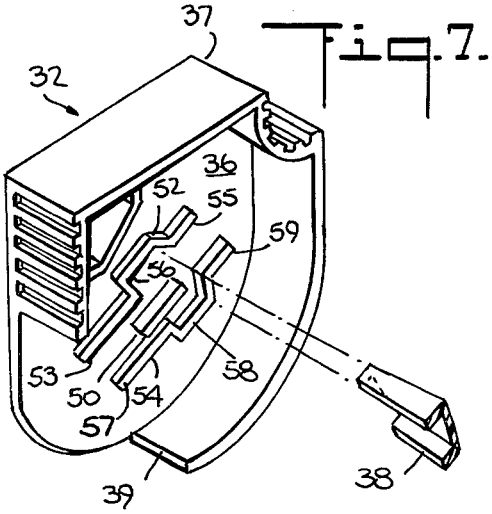
FIG. 7 is a perspective view of one side of the inking cartridge and a fixed beam extending from the other side of the inking cartridge. cl DETAILED DESCRIPTION In describing the preferred embodiment of the instant invention, reference is made to the drawings wherein there is seen in FIGS. 1–3 a mailing machine generally designated 10 having a pair of sidewalls 12 and 14. Each of the sidewalls 12 and 14 includes an opening generally designated 16 and 18 (see FIG. 4) respectively. The opening 16 has a locating guide edge 20 while the opening 18 has a locating guide edge 22. At the trailing end of the locating guide edge 20 is a leg or edge 24 which forms a perpendicular angle with the locating guide edge 20 while at the trailing end of the locating guide edge 22 is a leg or edge 26 which forms a perpendicular angle with the locating guide edge 22. The openings 16 and 18 also include abutting edges 27 and 29 respectively and entrance guides 31 and 33 respectively. The perpendicular angles may also be acute angles.
Figure 2:
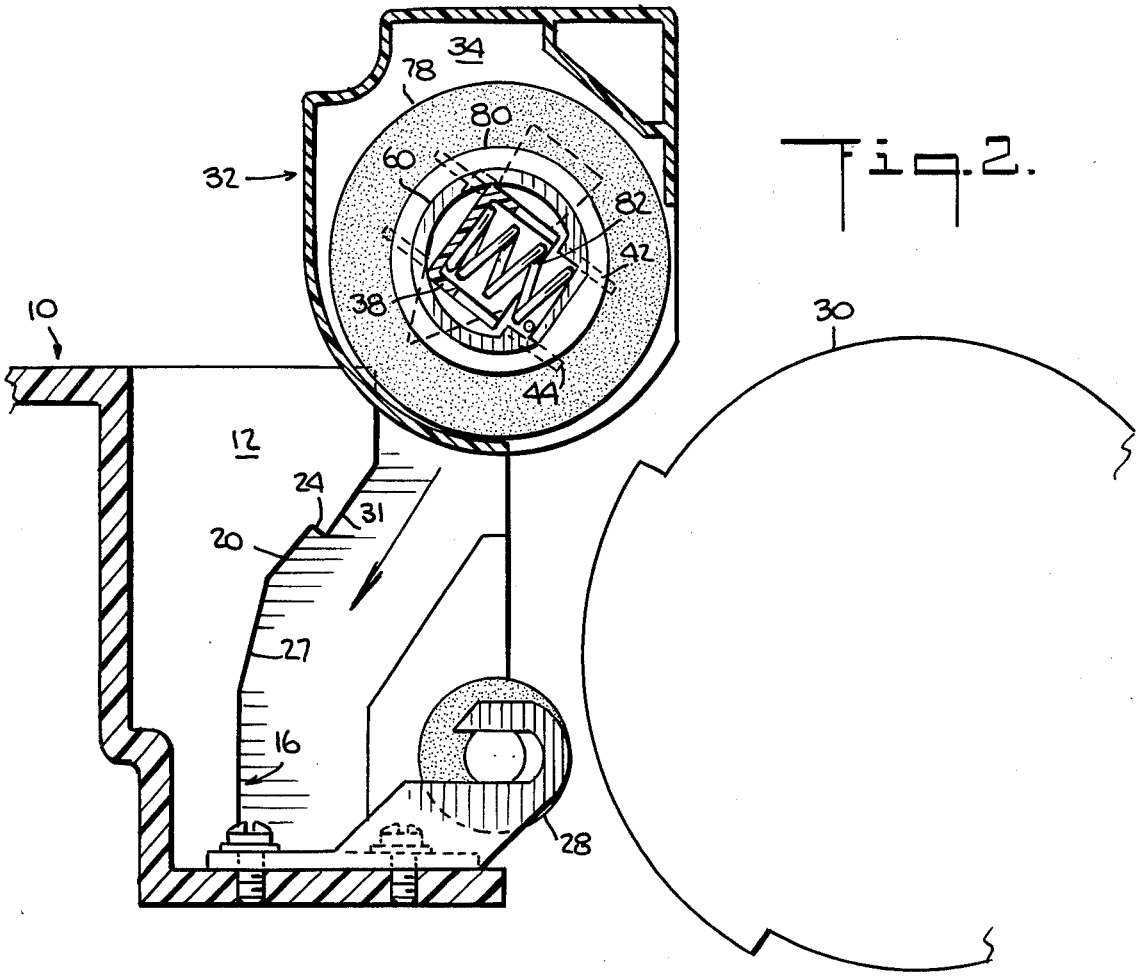
FIG. 2 is a vertical sectional view of the inking cartridge and housing seen in FIG. 1 and a printing drum as the cartridge is about to be inserted into the housing sidewalls.
Figure 3:
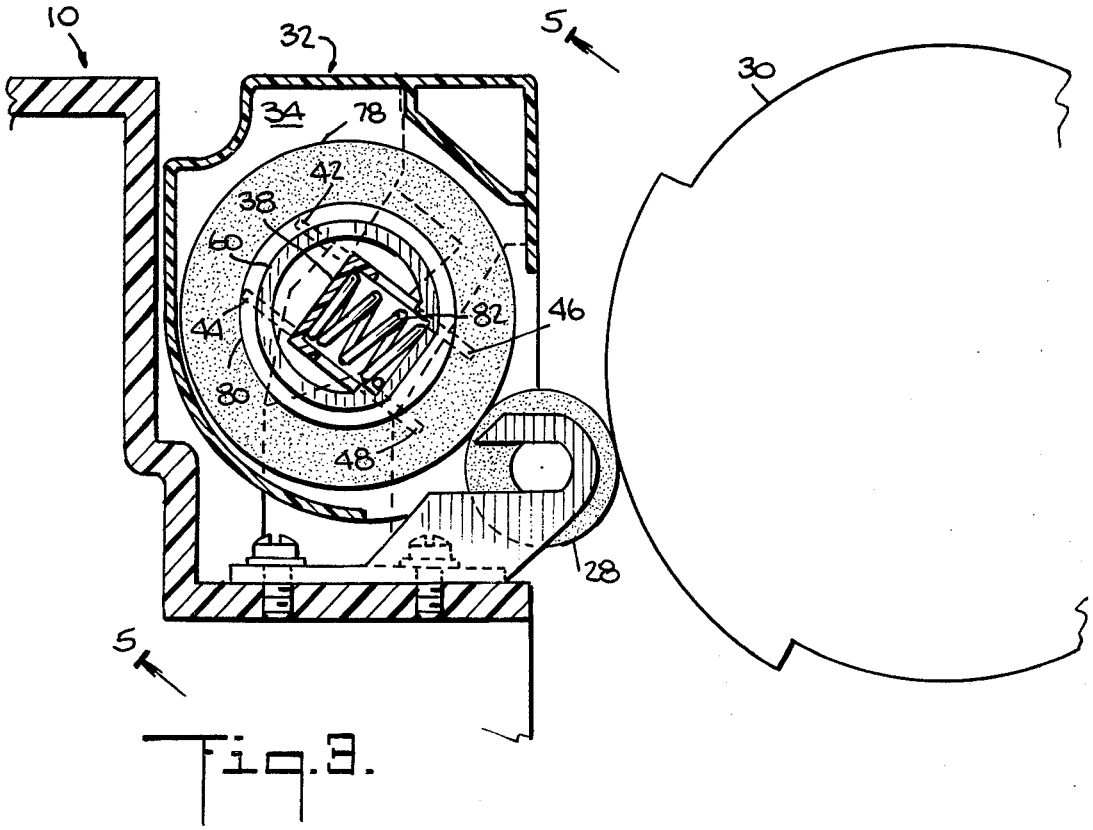
FIG. 3 is the same as FIG. 2 except that the cartridge has been fully inserted into the housing sidewalls and has engaged the applicator roller in the housing and the printing drum.
Figure 5:
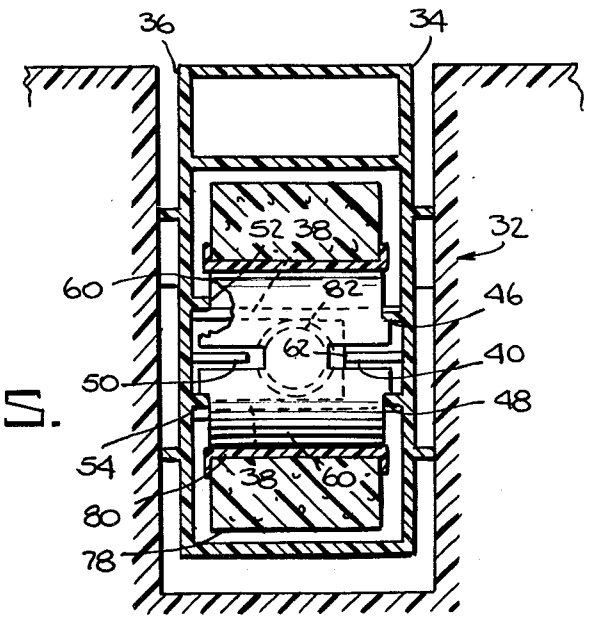
FIG. 5 is a sectional view taken on the plane indicated by the line 5—5 in FIG. 3.

Extending along the inside of the sidewall 36 is a perpendicular flange 50 (see FIGS. 5 and 7) and a pair of guide rails 52 and 54, which have straight sections 53 and 55 and 57 and 59 respectively. The wider interior sections 56 and 58 of rails 52 and 54 respectively receive the end of the fixed beam 38 extending from the sidewall 34.

Figure 6:
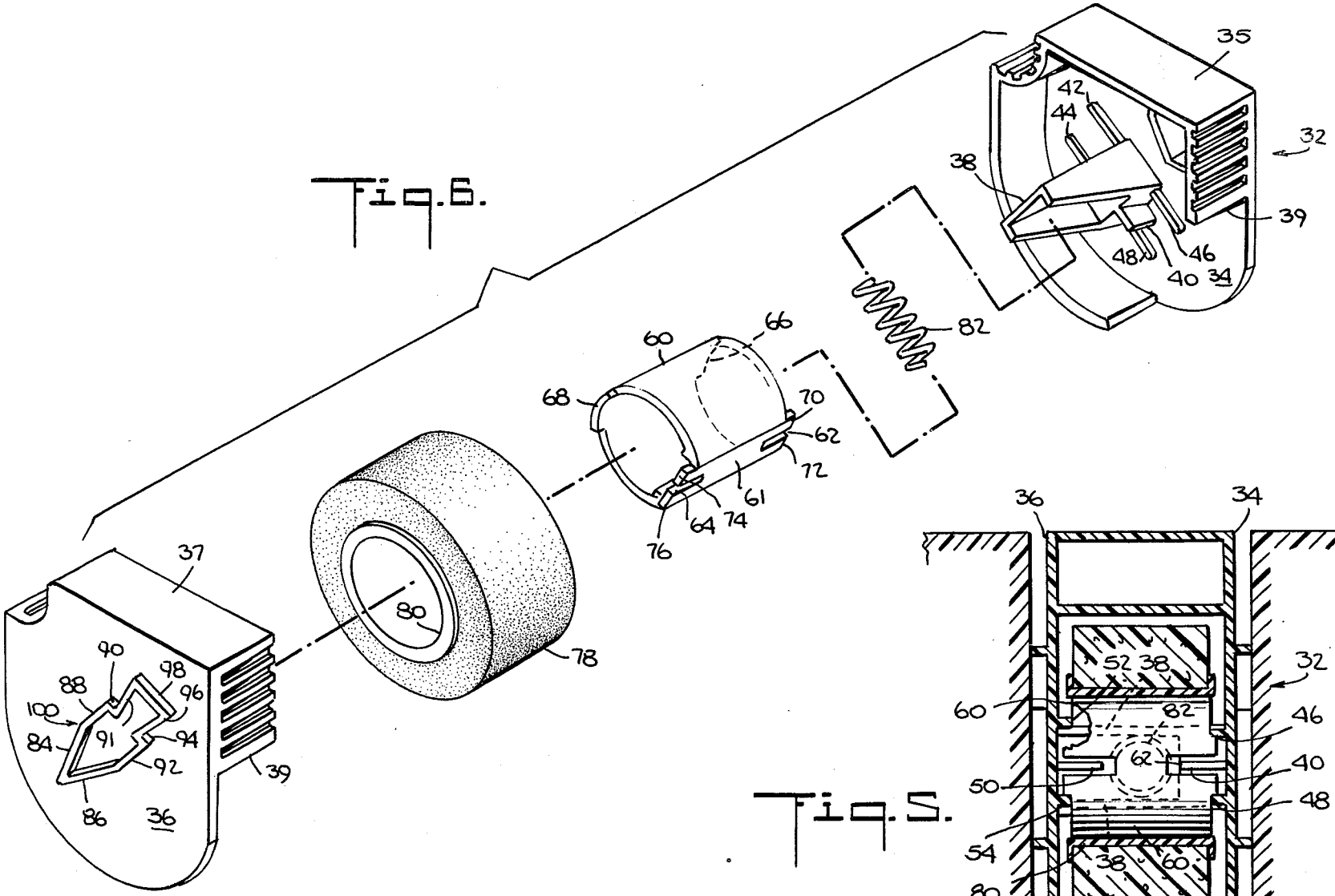
FIG. 6 is an exploded view of the inking cartridge of the instant invention.

The disposable inking cartridge 32 also includes a floating spindle 60 having a flat section generally designated 61 and characterized by a pair of slots 62 and 64 on one side and a pair of arcuate flanges 66 and 68 on the other side. On either side of the slot 62 are protruding flat ribs 70 and 72 while on either side of the slot 64 are protruding flat ribs 74 and 76. The floating spindle 60 is translatable in a direction parallel to the guide rails 42, 44, 46 and 48 by virtue of the arcuate flange 66 riding between the guide rails 42 and 44, the arcuate flange 68 riding between the straight rail sections 55 and 59, the flat ribs 70 and 72 riding within the guide rails 46 and 48 respectively and the flat ribs 74 and 76 riding within the straight rail sections 53 and 57 respectively. As best seen in FIG. 6, the extent of translation of the spindle 60 is governed by the beam 38. Additional guidance for the translation of the spindle 60 is provided by the slots 62 and 64 which are translatable over the flange portions 40 and 50 respectively.

An inking roller 78 is mounted on a core 80 which is rotatably mounted on the floating spindle 60. A coil spring 82 sits in compression between the beam 38 and the flat section 61 of the spindle 60 and thus biases the spindle 60 in a direction away from the beam 38 so that the spindle 60 is translatable in a direction perpendicular to the locating guide edges 20 and 22 in the openings 16 and 18 respectively in the sidewalls 12 and 14 respectively. The inking roller 78 protrudes through the aperture 39 to engage the applicator roller 28. From the foregoing, it can be appreciated that the spring 82 performs two functions, i.e. providing a float for the spindle 60 and locking the cartridge 32 into the sidewalls 12 and 14 of the mailing machine 10.

Figure 4:
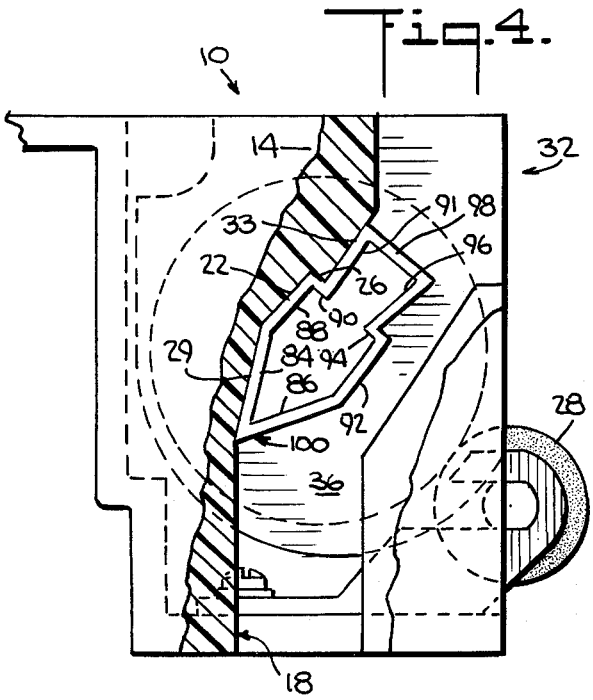
FIG. 4 is an enlarged, side elevational view, partially in section, of the cartridge lockingly engaging the housing sidewalls.

As best seen in FIGS. 1 and 6, the sidewalls 36 of the disposable inking cartridge 32 includes a pair of angled rail section 84 and 86. Just behind the rail section 84 is a locating guide rail 88, at the end of which is a leg rail 90 which forms a perpendicular angle with the locating guide rail 88, which may also be an acute angle and which acute angle is identical to the acute angle between the locating guide edge 22 and the leg 26 in the opening 16 in the sidewall 14. Also forming an acute angle with the guide rail 88 is an entrance rail 91 of the cartridge sidewall 36. As best seen in FIG. 4, the rails 84, 88, 90 and 91 of the cartridge sidewall 36 mate with the edges 29, 22, 26 and 33 respectively of the opening 18 in the housing sidewall 14. The sidewall 36 additionally includes rail sections 92, 94, 96 and 98, which together with the outer rail sections 84, 86, 88, 90 and 91 define an arrow generally designated 100 which indicates the direction for insertion of the cartridge 32 as described below. The sidewall 34 obviously includes similar rail sections, which are not shown.

In operation, when it is desired to insert the cartridge 32 into the mailing machine 10, the user merely positions the cartridge 32 as seen in FIG. 1 and slides the sidewalls 34 and 36 of the cartridge 32 between the sidewalls 12 and 14 respectively of the mailing machine 10 by pushing in a diagonally downward direction as indicated by the arrow 100. The protruding rail sections comprising the arrow 100 fit within the opening 18 and when the leg rail 90 of the cartridge 32 has passed the leg edge 24 of the opening 16 the floating spindle 60 urges the cartridge 32 upwardly so that it is locked into operating position as seen in FIG. 4 and the inking roller 78 is biased against the applicator roller 28. It is thus seen that the spring 82, through the floating spindle 60, performs the two functions of locking the cartridge into the sidewalls 12 and 14 of the mailing machine 10 and providing a bias for the inking roller 78 against the applicator roller 28. Removal of the cartridge 32 from the mailing machine 10 is accomplished by urging the cartridge 32 away from the locating guide edge 22 of the opening 18 until the cartridge rail 90 clears the entrance guide 31 of the opening 18, at which point the user merely withdraws the cartridge 32 in a direction opposite that suggested by the arrow 100.

It should be understood that although protruding rails have been shown on the cartridge 32, that in fact other guiding arrangements may be used, including the use of rails on the mailing machine 10 and slots or channels in the cartridge 32.

The exemplary embodiments described herein are presently considered to be preferred; however, it is contemplated that further variations and modifications within the purview of those skilled in the art can be made herein. The following claims are intended to cover all such variations and modifications as fall within the true spirit and scope of the invention.

What is claimed is:

1. A disposable inking cartridge in combination with said housing for transferring ink to a secondary surface, comprising:

a housing having a pair of sidewalls, each of said sidewalls having a locating guide, wherein the locating guide includes at its trailing end a leg forming an angle no greater than 90 degrees therewith;

an applicator roller rotatably mounted in said housing for transferring ink to said secondary surface; and said disposable inking cartridge lockingly mountable in the sidewalls of said housing, said cartridge having:

a floating spindle translatable in a direction perpendicular to the locating guides in said housing sidewalls, an inking roller rotatably mounted on said spindle and engagable with said applicator roller, and a pair of sidewalls, each of said sidewalls having a locating guide, wherein the cartridge locating guide includes at its trailing end a leg forming an angle no greater than 90 degrees therewith, and wherein the cartridge locating guide slidingly engages the housing locating guide, and means for biasing the floating spindle towards the applicator roller and for urging the legs of the cartridge guide into locking engagement with the legs of the housing guide when the cartridge is inserted into locking engagement with the housing sidewalls.

2. The combination of claim 1, wherein the housing sidewall locating guides comprises edges in openings in the housing sidewalls, and the cartridge sidewall locating guides comprise protruding rails.

3. The combination of claim 2, wherein each cartridge sidewall also includes a pair of angled rails one of which forms an obtuse angle with the cartridge sidewall locating guide rail.

4. The combination of claim 3, wherein each cartridge sidewall additionally includes an entrance rail forming an acute angle with the cartridge locating guide leg.

5. The combination of claim 4, wherein each housing sidewall opening includes edges which mate with the cartridge entrance rail and said one angled rail.

6. The combination of claim 5, wherein each cartridge sidewall includes additional rail sections the total of which define an arrow pointing in the direction of insertion of the cartridge into the housing.

* * * * *